US006722854B2

(12) United States Patent
Forsberg

(10) Patent No.: US 6,722,854 B2
(45) Date of Patent: Apr. 20, 2004

(54) CANNED PUMP WITH ULTRASONIC BUBBLE DETECTOR

(75) Inventor: Ronald A. Forsberg, Arvada, CO (US)

(73) Assignee: Sundyne Corporation, Arvada, CO (US)

( * ) Notice: Subject to any disclaimer, the term of this patent is extended or adjusted under 35 U.S.C. 154(b) by 528 days.

(21) Appl. No.: 09/768,962

(22) Filed: Jan. 24, 2001

(65) Prior Publication Data

US 2002/0098089 A1 Jul. 25, 2002

(51) Int. Cl.[7] ..... F04B 49/00; F04F 11/00
(52) U.S. Cl. ..... 417/63; 417/67
(58) Field of Search ..... 417/63, 369, 366, 417/367, 368, 370, 371

(56) References Cited

U.S. PATENT DOCUMENTS 3,960,245 A 6/1976 Weinrich
4,047,847 A 9/1977 Oikawa
4,652,218 A 3/1987 Tsutsui et al.
4,684,329 A 8/1987 Hashimoto
4,731,556 A * 3/1988 Adams ..... 310/338
4,838,763 A 6/1989 Kramer
4,890,988 A 1/1990 Kramer et al.
5,129,795 A * 7/1992 Hyland ..... 417/423.12
5,138,571 A * 8/1992 Ono et al. ..... 365/87
5,198,763 A 3/1993 Konishi
5,256,038 A 10/1993 Fairman
5,263,825 A 11/1993 Doolin
5,332,369 A 7/1994 Jensen
5,336,996 A 8/1994 Rusnak
5,345,829 A 9/1994 Yamauchi et al.
5,448,924 A 9/1995 Nagai et al.
5,562,406 A 10/1996 Ooka et al.
5,591,016 A 1/1997 Kubota et al.
5,592,039 A 1/1997 Guardiani
5,642,888 A 7/1997 Rockwood
5,692,886 A * 12/1997 Kobayashi et al. .... 417/423.12
5,696,444 A 12/1997 Kipp et al.
5,698,916 A 12/1997 Eguchi
5,777,217 A 7/1998 Misato et al.
5,785,013 A 7/1998 Sinn et al.
5,796,349 A 8/1998 Klein
5,833,437 A 11/1998 Kurth et al.
5,882,182 A 3/1999 Kato et al.
5,925,951 A 7/1999 Edwards et al.
5,929,336 A 7/1999 Belanger et al.
5,949,171 A 9/1999 Horski et al.
5,955,880 A 9/1999 Beam et al.
5,997,261 A 12/1999 Kershaw et al.
6,012,909 A * 1/2000 Sloteman et al. ..... 417/366
6,017,198 A 1/2000 Traylor et al.
6,085,574 A * 7/2000 Neftel et al. ..... 73/19.03
6,447,269 B1 * 9/2002 Rexroth et al. ..... 417/365
6,457,951 B2 * 10/2002 Rennett et al. ..... 417/366

* cited by examiner

*Primary Examiner*—Daniel Robinson
(74) *Attorney, Agent, or Firm*—Carlson, Gaskey & Olds

(57) ABSTRACT

An improved fluid detection mechanism for a canned motor pump includes a return passage which receives a fluid detector. The fluid detector is a bubble detector which can sense the presence of bubbles, or the lack of a fluid. The detector is preferably positioned in a return path for returning a cooling and lubricating pump fluid back to the pump chambers from the canned motor chamber. This location will likely be the hottest location and the lowest pressure location in the pump. This location provides a very good indication of when the motor is overheated. Also, the location provides a very good indication to identify the lack of adequate lubricating and cooling fluid being directed to the bearings. As such, the location provides benefits over the prior art.

12 Claims, 1 Drawing Sheet

CANNED PUMP WITH ULTRASONIC BUBBLE DETECTOR

BACKGROUND OF THE INVENTION

This invention relates to an improved positioning of a bubble detector in a return flow path in a canned pump.

Canned pumps are utilized to pump various fluids. Such canned pumps typically include a shroud sealing the rotor of an electric motor for driving the pump element from the motor drive element. In this way, pump fluid can pass over the rotor for cooling purposes, and also for lubricating the bearings. Thus, during operation of such a pump, a motor drive element, such as a stator, is positioned outwardly of the shroud and drives the motor rotor to rotate. The rotor drives a shaft for driving the pump impeller. The shaft is supported on bearings. A portion of the working fluid passing through the pump is diverted into the shroud chamber, and passes over the bearings and/or the motor rotor.

The diverted fluid passes back into the pump chamber through one of at least two flow paths. A portion of the fluid passes back through the impeller, and from the forward bearings. Typically, fluid which passes over the motor rotor returns through an outer flow path. This fluid will typically be the hottest fluid and at the lowest pressure.

Two problems in this type of pump are addressed by the present invention. First, if for any of several reasons the motor is operating at a unduly high temperature, the pump fluid will become hot also. This may result in bubbles being found in the pump fluid. It would be desirable to sense the occurrence of such an unduly high temperature such that pump operation can be stopped before any damage to the pump. Second, if there is a lack of cooling fluid passing over the bearings and rotors, it also would be desirable to quickly identify this lack of fluid such that operation of the pump can be stopped prior to any resultant damage.

In the past, sensors for detecting the presence of fluid have been incorporated at various locations. However, those locations have not been ideally located for quickly and accurately determining the presence of the problems mentioned above.

SUMMARY OF THE INVENTION

In the disclosed embodiment of this invention, a sealed pump unit has an impeller driven by a shaft through a motor rotor. A shroud seals a chamber around the motor rotor and shaft from a drive element for the motor. The drive element may be a stator, or can be a driven rotating magnetic member for driving the rotor.

A pump fluid is delivered to the impeller, and tapped from a first location for cooling and lubrication purposes. This tapped fluid passes over bearings supporting the shaft, and also passes over the motor rotor. This fluid is returned to the pump chamber through a return path. Preferably, a "bubble" detector is positioned in the return path to identify the presence of a sufficient quantity of liquid. If the sufficient quantity of liquid is not identified, then the sensor can predict that there are undue amounts of bubbles in the fluid flow, or that there is simply an insufficient liquid flow for cooling purposes. Either of these two conditions are communicated to a control which can take corrective action. The correction action can be actuating a warning signal, etc., or could be stopping the drive of the motor.

In a preferred embodiment of this invention the bubble detector is a two piece piezoelectric device which passes a charge between its two crystals through the pump liquid. If the liquid is between the two pieces in sufficient quantity, the signal will be as expected. However, should there be insufficient pump fluid, or the presence of bubbles above a predetermined amount, then the signal will be different from that which is expected. The corrective action can then be taken.

These and other features of the present invention can be best understood from the following specification and drawings, the following of which is a brief description.

DETAILED DESCRIPTION OF A PREFERRED EMBODIMENT

Figure 1A:
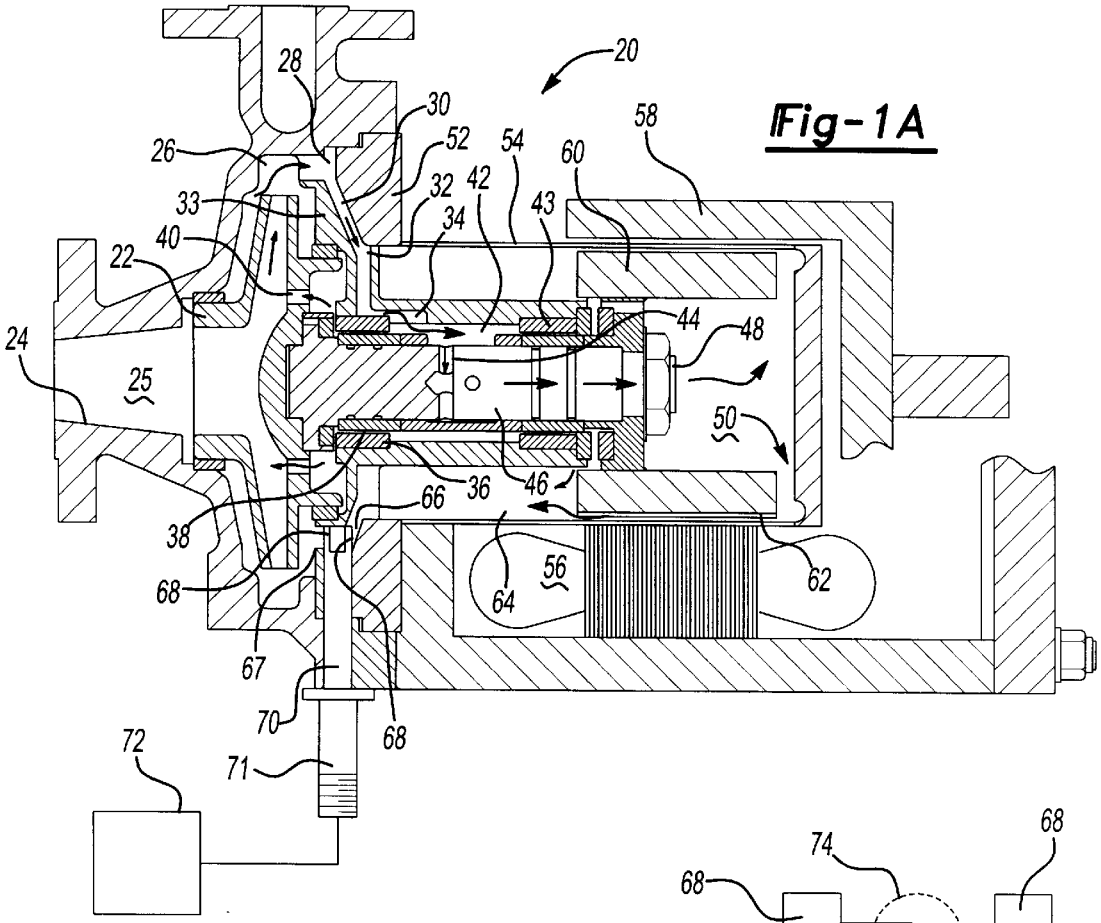
FIG. 1A is a cross-sectional view through an inventive pump.

A pump 20 is shown in FIG. 1A incorporating a centrifugal impeller 22 rotating within a pump chamber 24. An inlet 25 delivers pump fluid to the impeller, and the impeller pumps the fluid to an outlet 26, not fully shown in this view. A tap 28 is positioned at a first radially outer location, and taps fluid from the discharge chamber 26 through a tap port 30. Tap port 30 communicates with a second tap port 32. As shown in this view, the tap port 32 is formed within a fixed housing element 33, while the tap port 30 may be defined between the housing element 33 and a shroud member 52.

From port 32 the fluid flows into a chamber 34, and may pass over a front bearing 36. As shown, there is clearance 38 inwardly of the bearing and fluid may flow through that clearance, for cooling the bearing. Fluid flowing forwardly over the bearing 36 through the clearance 38 can pass through return ports 40 back to the impeller 22.

Fluid flowing in a rearward direction relative to the forward bearing 36 passes into a chamber 42, and may pass over a bearing 43 through a similar clearance 38. Further, other fluid passes into ports 44 and through an axial port 46 to an outlet 48. This fluid then passes into a chamber 50. Chamber 50 is defined by the shroud 52, and through a cylindrical can portion 54 of the shroud 52. Although the shroud 52 and 54 is shown as a one-piece item, other types of shrouds made of multiple pieces would benefit from this invention. A motor drive unit 56 or 58 drives a rotor 60 within the chamber 50. The illustrated alternative drive unit 56 is a motor stator, whereas the drive unit 58 is a driven rotating magnetic member. This aspect of the invention is as known, and the rotor 60 may be driven by any known method. The purpose of the shroud 52 and 54 is to seal the chamber 50 within which the rotor 60 rotates, such that the pump fluid can circulate over the bearings and motor rotor 60 for cooling and lubrication purposes.

As shown, fluid passes through passages 62 radially outwardly of the rotor for cooling, and then into a chamber 64. Fluid may also pass into the chamber 64 after having cooled the bearing 43. From chamber 64 the fluid passes into a return passage 66 and through an outlet 67 back into the discharge chamber 26. The fluid leaving passage 66 and 67 will be among the hottest fluid within the entire pump 20, as it has cooled the rotor 60. Further, the fluid will be at a relatively low pressure compared to fluid elsewhere in the pump 20. The fluid is driven between the tap 28 and the outlet 67 will be powered by the fact that the outlet 67 is radially inward of the tap 28, thus tap 28 will be at a higher pressure, driving the fluid flow.

Within the passage 66 is a sensor 70 having two piezoelectric crystal portions 68 spaced by a distance.

Figure 1B:
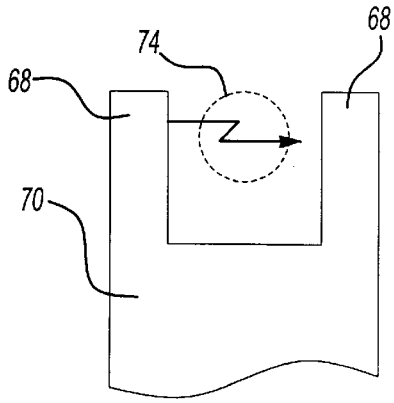
FIG. 1B shows an enlarged view of a sensor according to the present invention.

As shown in FIG. 1B, a bubble 74 found between the two piezoelectric crystal elements 68 will modify a signal sent between the two. One of the elements 68 provides a transmitter and the other a receiver. The signal will pass between the elements provided there is sufficient liquid between the two. If there are too many bubbles, or no liquid at all, then the signal will not pass properly between the two, and will not be as expected. Such bubble detectors are known in the art, but have not been utilized at the claimed location, or for the same claimed purpose.

The sensor 70 includes an outlet element 71 connected to a control 72. If the signal sensed across the two piezoelectric elements 68 is not as expected, then a determination can be made at control 72 that there are either an undesirably high number of bubbles 74 between the elements 68, or simply a lack of fluid between the elements 68. Either of these two conditions is indicative of a problem. An undue amount of bubbles is indicative of the temperature of the fluid being too high such that a prediction can be made that there is some problem within the motor.

The presence of no fluid is of course indicative of a lack of pump fluid, such as may be due to a lack of suction. Either condition would cause control 72 to take some corrective action. The corrective action could be the actuation of a warning signal or the stopping of the motor.

The inventive position of the sensor 70 within the return 66 places the sensor at the location which is likely to be at the highest temperature and the lowest pressure. The sensor is thus ideally situated for identifying a potential problem within the system.

Figure 2:
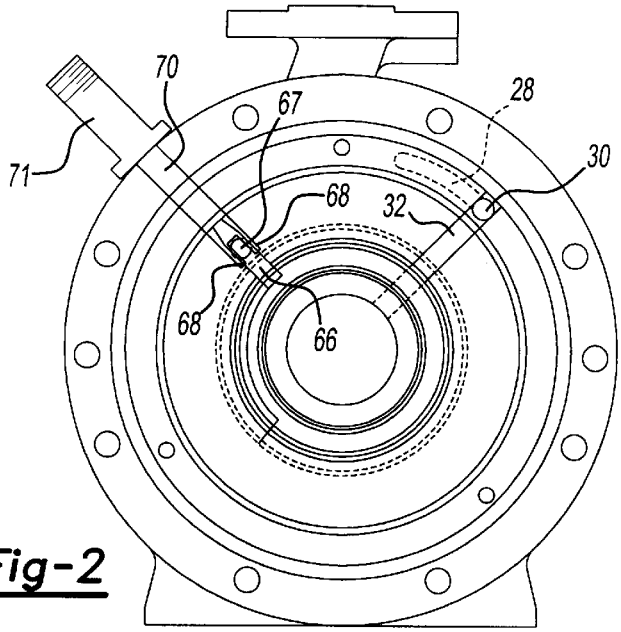
FIG. 2 is a cross-sectional view taken at approximately 90° to the FIG. 1A view.

FIG. 2 shows a location of the sensor 70 relative to the tap 28. As can be seen, the exit 67 is radially inward of the tap 28 such that fluid will flow through as described.

Although a preferred embodiment of this invention has been disclosed, a worker in this art would recognize that certain modifications would come within the scope of this invention. For that reason, the following claims should be studied to determine the true scope and content of this invention.

What is claimed is:

1. A canned pump assembly comprising:

a pump impeller driven by a shaft, said shaft being driven to rotate by a motor rotor;

a housing defining a pump chamber including an inlet and a discharge portion, and said housing further including a shroud providing a sealed fluid chamber around said shaft and said motor rotor;

a drive for driving said rotor positioned outwardly of said shroud; and a cooling system comprising a tap for tapping a fluid from said pump chamber, said tap directing fluid into said sealed chamber and over said motor rotor, and a return path for directing said tapped fluid back into said pump chamber, and a fluid detector positioned within said return path for detecting the presence of fluid in said return path.

2. A pump as recited in claim 1, wherein said fluid detector is a bubble detector which is capable of detecting the presence of bubbles, and the lack of fluid.

3. A pump as recited in claim 2, wherein said bubble detector includes a pair of spaced piezoelectric elements, and the presence or lack of fluid between said spaced elements is detected by said detector.

4. A pump as recited in claim 3, wherein said detector communicates with a control for taking corrective action should the amount of fluid between said elements be other than as expected.

5. A pump as recited in claim 1, wherein said detector takes correction actions if a lack of a predetermined amount of fluid is detected.

6. A pump as recited in claim 1, wherein a pair of bearings are positioned between said housing and said shaft, and said cooling fluid flowing over said bearings as well as said motor rotor.

7. A pump as recited in claim 6, wherein a portion of said fluid passes through said shaft and into said chamber for communicating with said rotor, said portion of said fluid moving into an outer housing chamber radially outward of a housing portion housing said bearing, and then to said return chamber.

8. A pump as recited in claim 1, wherein said tap is positioned further radially outwardly in said pump chamber than said return passage.

9. A pump as recited in claim 1, wherein said drive is a motor stator.

10. A pump as recited in claim 1, wherein said drive is a rotating magnetic element.

11. A canned pump assembly comprising:

a pump impeller driven by a shaft, said shaft being driven to rotate by a motor rotor;

a housing defining a pump chamber including an inlet and a discharge portion, and said housing further including a shroud providing a sealed fluid chamber around said shaft and said motor rotor, a pair of bearings positioned between said housing and said shaft;

a drive mechanism for driving said rotor positioned outwardly of said shroud; and a cooling system comprising a tap for tapping a fluid from said pump chamber, said tap directing fluid into said sealed chamber and over said motor rotor, said fluid also flowing over said bearings, and there being a return path for directing said tapped fluid back into said pump chamber, and a fluid detector positioned within said return path for detecting the presence of fluid in said return line.

12. A pump as recited in claim 11, wherein a forward one of said bearings being associated with one return path, and a rearward one of said bearings along with said motor rotor being associated with said return path which receives said fluid detector.

* * * * *